United States Patent [19]

Sabo

[11] 4,182,310

[45] Jan. 8, 1980

[54] HEAT RETAINING DEVICE

[76] Inventor: Michael Sabo, 1001 E. Price St., Philadelphia, Pa. 19138

[21] Appl. No.: 854,362

[22] Filed: Nov. 23, 1977

[51] Int. Cl.[2] ..... F24H 7/06

[52] U.S. Cl. ..... 126/400; 126/39 F; 122/14

[58] Field of Search ..... 122/14; 126/400, 39 A, 126/39 D, 39 E, 39 F, 39 J, 252, 350 R; 431/278

[56] References Cited

U.S. PATENT DOCUMENTS

| | | | |
|---|---|---|---|
| 1,797,102 | 3/1931 | Rossi | 126/215 |
| 2,094,908 | 10/1937 | Thrall | 126/350 R |
| 2,311,484 | 2/1943 | Stack | 122/14 |
| 2,352,329 | 6/1944 | Koppel | 431/278 |
| 2,516,738 | 7/1950 | Woolley | 126/400 |
| 2,843,199 | 7/1958 | Brodbeck | 431/278 |

FOREIGN PATENT DOCUMENTS

| | | | |
|---|---|---|---|
| 60454 | 3/1912 | Switzerland | 126/400 |

*Primary Examiner*—Larry I. Schwartz
*Attorney, Agent, or Firm*—Stuart E. Beck

[57] ABSTRACT

A heat retaining device comprising a plurality of heat retaining elements which can be positioned on the burner of a hot water heater. While the burner is ignited they collect and store heat from the burner which ordinarily might be wasted. After the burner is de-energized the heat that they release keeps the water in the hot water heater warm so that the intervals between energization of the burner are increased and fuel is saved thereby.

9 Claims, 2 Drawing Figures

HEAT RETAINING DEVICE

Figure 1:
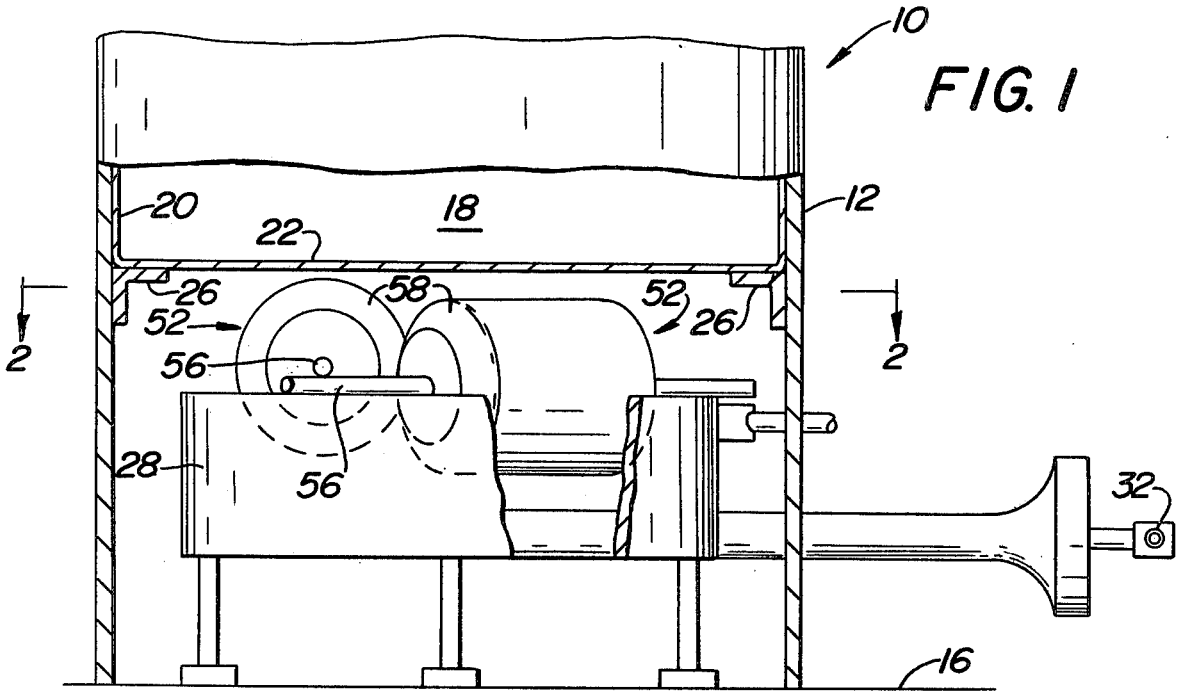

This invention relates to a device for conserving fuel and more particularly to a device which is useful in connection with hot water heaters.

It is well-known that in systems for heating water by means of open flame such as in gas and oil heated hot water heaters, much of the heat created by burning the fuel is lost to the air. Only a portion of that heat is used to heat the water.

Additionally, as the water in the hot water heater cools between intervals of energization of the burner, it is necessary to re-energize the burner to reheat the water.

The present invention deals with these two problems and as a result makes a hot water heater a more effective instrument by reducing the amount of time that a heater need to be energized in order to retain the water contained therein at a predetermined temperature.

This is accomplished by the present invention which relates to a heat retaining device for use with a hot water heater of the type that includes a pilot light and a selectively energizable burner for a fuel which is ignited by the pilot light and which has a chamber for the water which is to be heated. The heat retaining device includes at least one heat retaining element which comprises an elongated heat transfer element and a heat retaining member. The heat retaining member is operable to be supported on the burner between the burner and the water storage chamber so that the heat retaining member absorbs heat when the burner is energized and releases heat when it is de-energized to continue to heat the water in the storage chamber. At least a portion of the elongated heat transfer element is in touching thermal contact with the pilot light to provide a continuous supply of heat to the heat retaining element.

Figure 2:
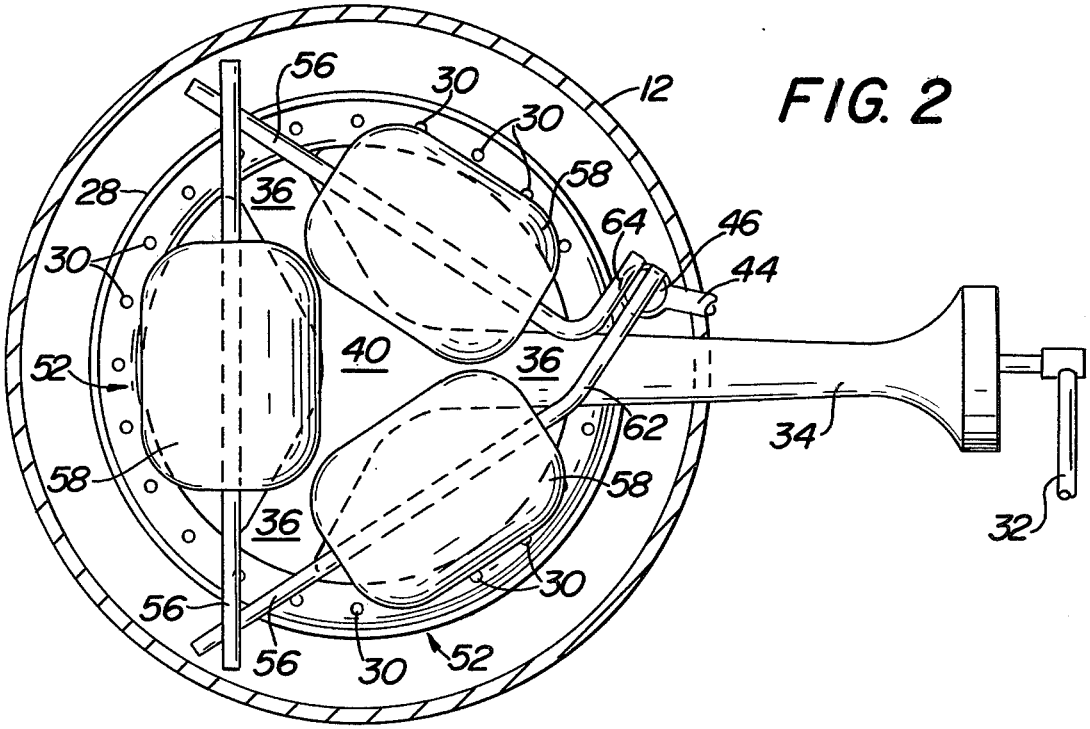

For the purpose of illustrating the invention, there are shown in the drawings certain forms which are presently preferred, it being understood, however, that this invention is not limited to the precise arrangement and instrumentalities shown and wherein:

FIG. 1 is a side elevation view, partially in section, of one presently preferred form of the invention, and FIG. 2 is a sectional view taken along line 2—2 of FIG. 1.

Now referring to the drawing for a detailed description of the invention, FIG. 1 illustrates a hot water heater 10 having a conventional design. It is generally cylindrical in shape and stands on its base. It includes a relatively thick outer wall 12 which may rest on the floor 16 on which the hot water heater is supported. The outer wall supports a water heating chamber 18 which is defined by inner cylindrical wall 20 which lies along the outer wall 12 and bottom wall 22. The water heating chamber may be supported on the outer wall by an annular flange 26.

Water is introduced into and withdrawn from the water heating chamber in a conventional manner which forms no part of the present invention. Accordingly, the manner by which this is accomplished will not be described.

In the embodiment of the invention illustrated the water in the water heating chamber 18 is heated by a gas burner 28. The burner is generally circular in cross section and includes a plurality of apertures 30 through which gas can escape. Gas is fed to the burner by way of a fuel line 32 which is connected to burner inlet 34.

The burner inlet is connected to a plurality of radially directed arms 36. Each of the arms are connected to each other at their central portion or hub 40. At their other ends they are connected to the ring 28 to provide a uniform distribution to the ring of the gas which flows through fuel line 32 and inlet 34. The burner is selectively and intermittently energized in a conventional manner. Normally, this energization occurs when the water in the water heating chamber falls below a predetermined temperature and it is de-energized when the water rises above a predetermined temperature.

Additionally, a second fuel supply line 44 is provided for supplying gas to a pilot light 46. The pilot is positioned so that it can ignite the gas flowing to the burner ring 28. However, the pilot light also has another purpose which will be made apparent from what follows.

Heat retaining devices 52 may be provided for increasing the efficiency of the burner. While a plurality of such devices are illustrated, it will follow from the description contained herein that only one of such heat retaining devices need by provided. However, the efficiency of the device increases as their number is increased. Each heat retaining element comprises an elongated heat transfer element 56 which supports a heat retaining member 58. The heat transfer elements 56 may be made of a suitable efficient heat conductive material such as steel. On the other hand, the heat retaining member 58 is preferably made of a material which has a high capacity to absorb heat. Suitable materials include cast iron and terra-cotta. While only a limited number of examples of the types of materials that could be used for the heat transfer element and heat retaining member have been given, it is apparent that other materials would also be suitable.

The heat retaining elements are supported on the burner 28 so that they lie between the burner and the bottom wall 22 of the water heating chamber 18. Preferably, the heat retaining members 58 are relatively large cylindrical elements that can lie relatively close to the bottom wall.

As is apparent, while the burner is energized to heat the water in the chamber 18, heat which might otherwise be lost is used to heat the heat retaining members 58. After the burner is de-energized, the heat released from the members 58 continues to provide heat to the water in chamber 18.

As best seen in FIG. 2 the end portions 62 and 64 of two of the elongated heat transfer elements are angularly disposed relative to the remainder of those elements so that they can lie in touching thermal contact with the pilot light 46. This enables a continuous supply of heat to be conveyed to the heat retaining members 58 and the bottom wall 22 even when the burner 28 is deenergized.

Preferably, as illustrated in FIG. 2 a number of heat retaining elements are provided. They are arranged so that the heat retaining members are supported between adjacent arms 36 on the burner and their heat transfer elements 56 are in touching thermal contact with each other. Since the heat transfer elements are in touching thermal contact with each other, a flow of heat between all of the heat retaining elements is maintained so that heat is supplied in a uniform fashion to the bottom wall.

It should be appreciated that the heat retaining elements may be provided as an integral part of a hot water heater having a burner of the type illustrated, or they could be provided separately, as a kit, for example, whereby they would be installed by the owner of the hot water heater.

Further, while the invention has been described in the context of a gas burner, it is apparent that it is suitable for use in connection with a burner for any type of fuel provided there are means on the burner which enable heat retaining elements of the type described herein to be supported thereon.

Thus, while the invention has been described with respect to certain forms thereof, it is apparent that other forms would be obvious to a person skilled in the art in view of the foregoing specification and drawing. Thus, the scope of the invention should not be limited by the specification and drawing, but rather, only by the scope of the claims appended hereto.

I claim:

1. A heat retaining device for use with a hot water heater of the type that includes a pilot light and a selectively energizable burner for a fuel which is ignited by the pilot light and which has a chamber for the water which is to be heated disposed above the burner, and wherein the burner includes an outer annular burner element and an arm therein and connected thereto for directing fuel to the annular burner element comprising, at least one heat retaining element; said heat retaining element comprising an elongated heat transfer element and an enlarged heat retaining member; said enlarged heat retaining element being disposed intermediate the ends of said elongated heat transfer element and being supported thereby, and being disposable on the burner between the burner and the water heating chamber when said elongated heat transfer element is supported by said annular burner element so that said heat retaining member can absorb heat when said burner is energized and release heat when said burner is de-energized to continue to heat water in the water heating chamber; and at least a portion of said elongated heat transfer element is disposed so that it can be in contact with the pilot light to provide a continuous supply of heat by way of the heat transfer element to the heat retaining element when the burner is de-energized.

2. A device as defined in claim 1 including a plurality of heat retaining elements arranged on the burner, and some of said heat retaining elements that are adjacent to each other have their heat transfer elements in touching relation to each other to enable heat to be transferred between said adjacent heat retaining elements.

3. A device as defined in claim 2 wherein the heat transfer element of at least another one of said heat retaining elements is disposed so that it can lie on touching thermal contact with the pilot light.

4. A device as defined in claim 2 wherein said heat retaining elements are made from cast iron.

5. A device as defined in claim 2 wherein said heat retaining elements are made from terra-cotta.

6. A device as defined in claim 2 wherein said heat retaining elements are generally cylindrical and have relatively large diameters with respect to the cross section of said heat transfer elements so that they can be close to the water heating chamber of said heat transfer element so that it can lie in touching thermal contact with the pilot light.

7. A device as defined in claim 2 wherein the burner includes a ring and a plurality of radially directed, centrally located arms, the arms being connected to each other at one of their ends and being connected to the ring at their other ends, and said heat retaining element is supported by said arms.

8. A device as defined in claim 7 wherein the end portion of said heat transfer element is disposed at an angle relative to the remainder of said heat transfer element so that it can lie in touching thermal contact with the pilot light.

9. A device as defined in claim 8 wherein the end portion of another one of said heat transfer is disposed at an angle relative to the remainder of said other heat transfer element, and both of said end portions are disposed in touching thermal contact with the pilot light.

* * * * *

UNITED STATES PATENT AND TRADEMARK OFFICE

CERTIFICATE OF CORRECTION

PATENT NO. : 4,182,310

DATED : January 8, 1980

INVENTOR(S) : Michael Sabo

It is certified that error appears in the above-identified patent and that said Letters Patent are hereby corrected as shown below:

Claim 3, line 3; change "on" to --in--.

Claim 6, line 5; after "chamber" insert --,-- and the end portion of said heat transfer element is disposed at an angle relative to the remainder--.

Claim 9, line 2; after "transfer" insert --elements--.

Signed and Sealed this

*Twenty-ninth* Day of *April 1980*

[SEAL]

*Attest:*

SIDNEY A. DIAMOND

*Attesting Officer*

*Commissioner of Patents and Trademarks*